US006905419B1

(12) United States Patent
Yeh

(10) Patent No.: US 6,905,419 B1
(45) Date of Patent: Jun. 14, 2005

(54) MOUNT FOR ATTACHING LASER AIMING DEVICE TO GOLF PUTTER

(76) Inventor: Chung-Kai Yeh, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/762,138

(22) Filed: Jan. 22, 2004

(51) Int. Cl.[7] ..... A63B 69/36
(52) U.S. Cl. ..... 473/220
(58) Field of Search ..... 473/219, 220, 473/221, 226, 227

(56) References Cited

U.S. PATENT DOCUMENTS 6,450,893 B1 * 9/2002 Primiano et al. ..... 473/220
6,602,145 B1 * 8/2003 Yeh ..... 473/220
6,605,005 B1 * 8/2003 Lin ..... 473/220
6,739,981 B1 * 5/2004 Lin ..... 473/219
2004/0023726 A1 * 2/2004 Ritson et al. ..... 473/220

* cited by examiner

*Primary Examiner*—Raleigh W. Chiu

(57) ABSTRACT

A mount for attaching a laser aiming device to a golf putter comprises a laser bracket for housing a laser aiming device and a golf-club holder. The laser bracket is provided with a sliding recess on a lateral side thereof, being tapered off upwardly. The golf-club holder has a flat portion for being embedded into the sliding recess on the laser bracket and a circular portion for holding a golf club. Thereby, the laser bracket can be fastened together with the golf-club holder as the flat portion is inserted along the sliding recess. At least one non-slip rubber pad is disposed on the inner wall of the circular portion of the golf-club holder, and a retaining screw is installed on the outer side of the circular portion of the golf-club holder. The rubber pad and the retaining screw further enhance the golf-club holder's grip on a golf putter.

1 Claim, 5 Drawing Sheets

MOUNT FOR ATTACHING LASER AIMING DEVICE TO GOLF PUTTER

FIELD OF THE INVENTION

The present invention relates to laser aiming devices for a golf club, more particularly to a mount for attaching a laser aiming device to a golf club.

BACKGROUND OF THE INVENTION

Laser aiming device for a golf putter is an important training tool for golf putting. By a suitably aligned laser beam emitted form the aiming device, a golf player learns to aim at a laser mark on a golf ball during a stroke so as to learn the right body movement.

Referring to FIG. 1, a laser aiming device on the shaft of a golf putter according to U.S. Pat. No. 6,602,145 B1 to Yeh comprises a bracket a, a laser emitting device set b and one or two covers c. The covers c are attached onto the bracket a by a plurality of screws c1. The bracket a, made by injection molding or punching molding, is provided with a straight groove a1 compatible with a golf-club shaft, a recess a2 for housing a battery, a switch b1, a large hole a3 and a small hole a4 for housing a laser emitting device b2 and a plurality of screw holes a5. The screw holes a5 on the back side of the covers c, corresponding to screw holes a5, are tapered inwardly so as to conceal the heads of the screws c. The shaft of a golf putter 10 is coupled with the straight groove a1 of the bracket a, with a rubber pad a11 sandwiched therebetween. The screws c go through the tapered screw holes c2 and screw holes a5, so that the covers c, the golf putter 10 and the bracket a are bound together.

The mounting of the prior art on a golf putter 10 is shown in FIG. 2. This conventional laser mount is disadvantageous in that a suitable screw driver is needed to mount on or dismount from a golf putter. And, it also costs significant time to assemble, therefore presenting an inconvenience to a golf play.

SUMMARY OF THE INVENTION

Accordingly, the primary object of the present invention is to provide a mount for attaching a laser aiming device to a golf putter. The mount is characterized by a sliding recess formed on a lateral side thereof for attaching a golf-club holder. The golf-club holder is a plate made of an elastic material folded into a flat portion for being embedded into the sliding recess and a circular portion for grasping a golf club shaft. A laser aiming device can be easily and swiftly locked on the mount. The inner wall of the circular portion of the golf-club holder is provided with rubber pads, and the opening of the golf-club holder, which is at the outer side of the circular portion, is provided with a retaining screw. The rubber pads and the retaining screw fix the golf-club holder firmly on a golf putter, immovable even when a golf player wields fiercely.

The various objects and advantages of the present invention will be more readily understood from the following detailed description when read in conjunction with the appended drawings.

DETAILED DESCRIPTION OF THE PREFERRED EMBODIMENTS

Figure 1:
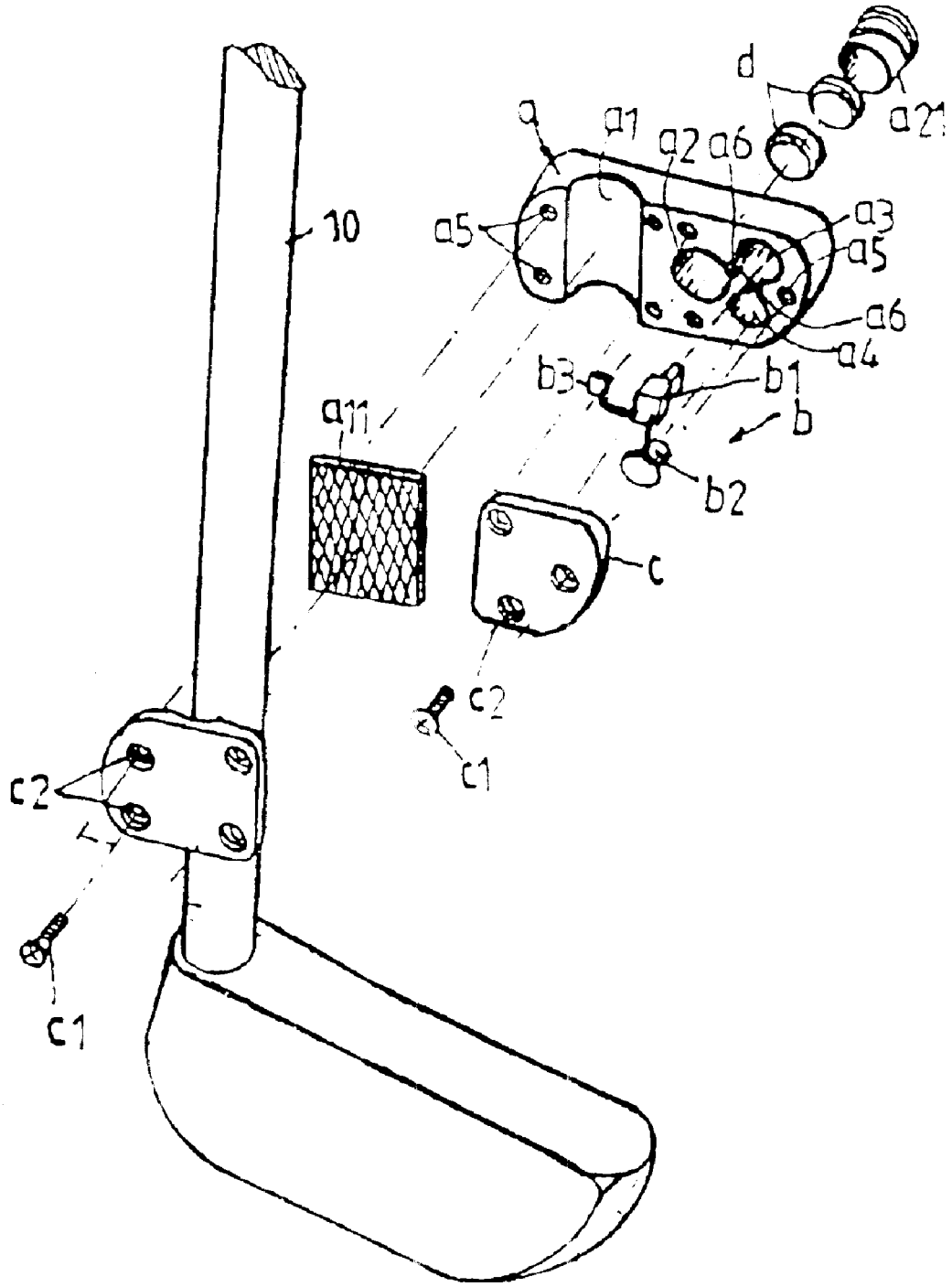
FIG.1 (PRIOR ART)
FIG. 1 is an exploded perspective view of a laser aiming device on the shaft of a golf putter according to the prior art.
Figure 2:
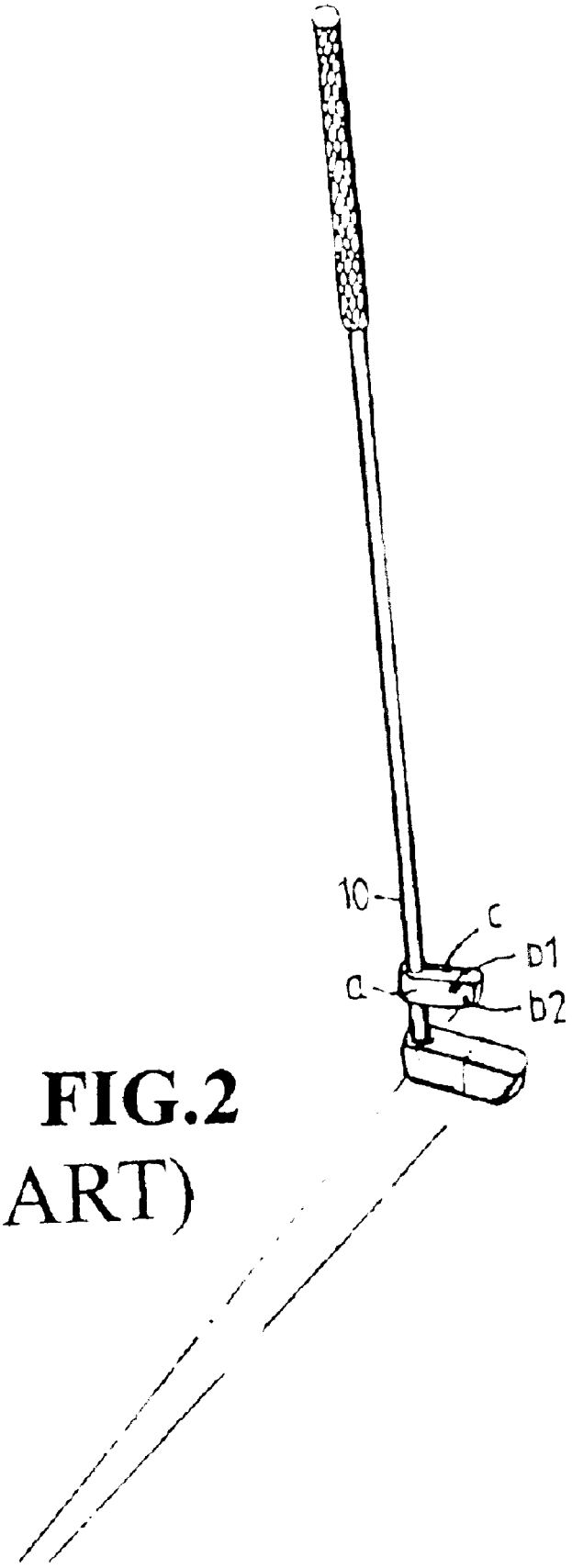
FIG.2 (PRIOR ART)
FIG. 2 is a perspective view of a laser aiming device on the shaft of a golf putter according to the prior art, when mounted on a golf putter.
Figure 3:
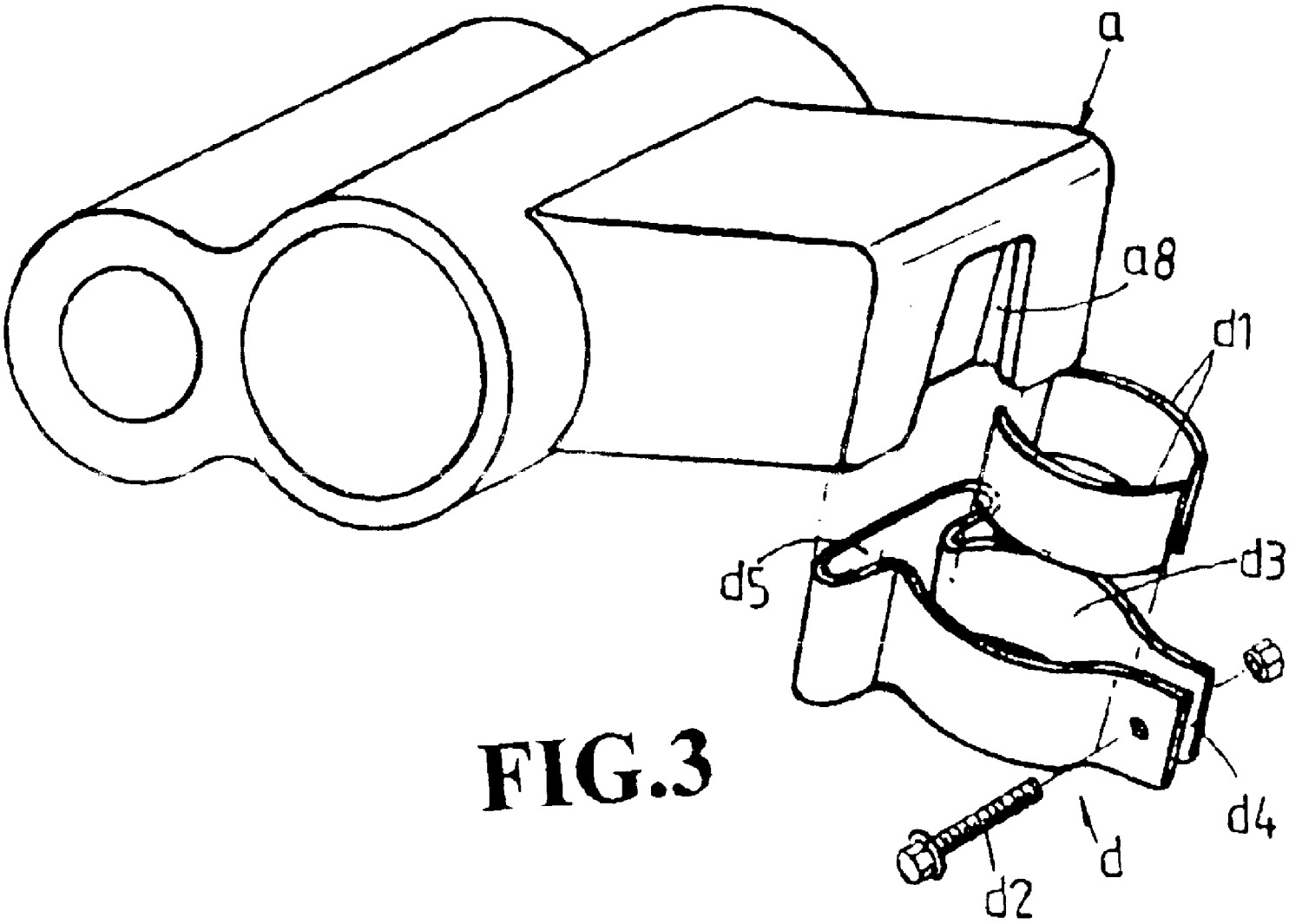
FIG. 3 is an exploded perspective view of a mount for attaching a laser aiming device to a golf putter according to the present invention.

Referring to FIG. 3, a mount for attaching a laser aiming device to a golf putter according to the present invention comprises a laser bracket a and a golf-club holder d. The laser bracket a is for housing a laser aiming device and is provided with a sliding recess a8, which is formed on a lateral side of the laser bracket a. The sliding recess a8 has an opening tapered off upwardly. The golf-club holder d has a hollow flat portion d5 for being embedded into the sliding recess a8 on the laser bracket a and a hollow circular portion d3 for holding the shaft of a golf putter 10. The hollow flat portion d5 is communicated to the hollow circular portion. Thereby, the laser bracket a can be fastened together with the golf-club holder d as the flat portion is inserted and slid along the sliding recess a8. The inner wall of said circular portion of said golf-club holder d is provided with at least one non-slip rubber pad d1, and the outer side of the circular portion of the golf-club holder d is provided with a retaining screw d2. The rubber pad d1 and the retaining screw d2 enhance the grip of the golf-club holder d on the golf putter 10.

Figure 4:
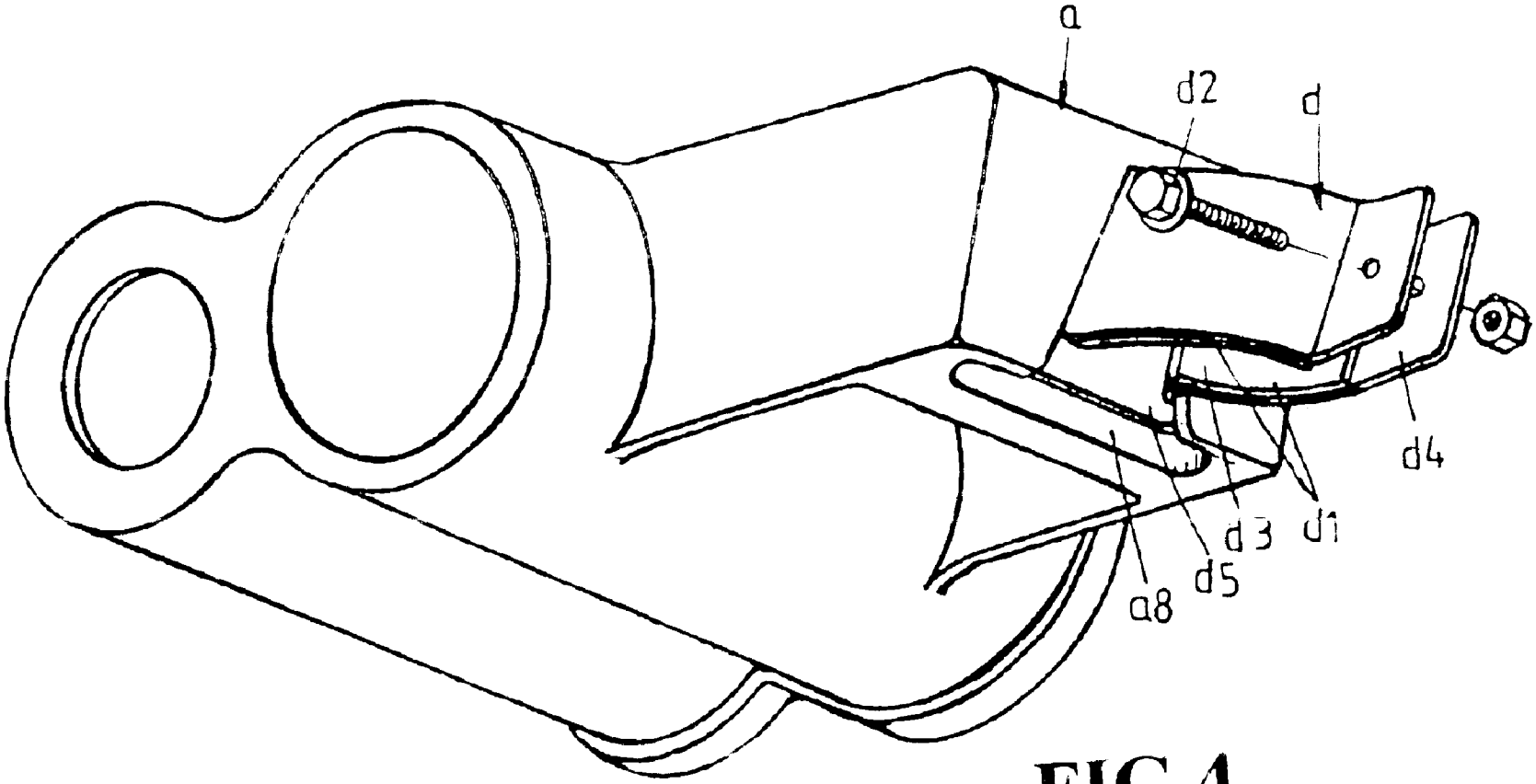
FIG. 4 is a perspective view of a mount for attaching a laser aiming device to a golf putter according to the present invention.
Figure 5:
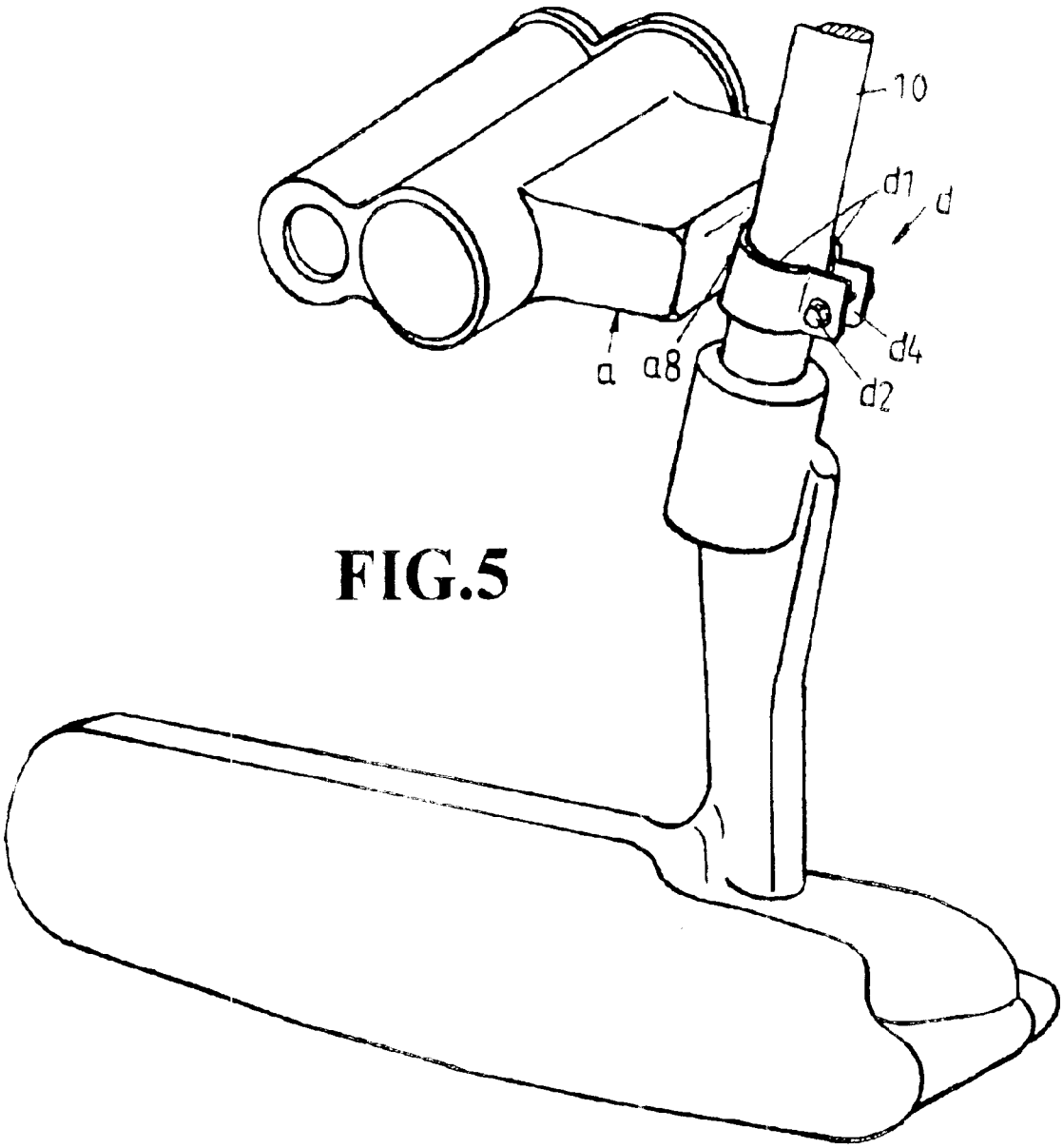
FIG. 5 is a perspective view of a mount for attaching a laser aiming device to a golf putter according to the present invention, when mounted on a golf putter.

Referrign to FIGS. 4 and 5, the circular portion d3 of the golf-club holder d can be coupled with the shaft of the golf putter 10. The diameter of the circular portion d3 is substantially that of the golf putter 10, and therefore it can stably hold the golf putter 10. The opening d4 of the golf-club holder d is further provided with a retaining screw d2 for adjusting the strength of the grip of the circular portion d3 on the golf putter 10. The laser bracket a, carrying a laser aiming device, is coupled with the golf-club holder d so that the laser aiming device is mounted on a golf putter 10. It is realized by the flat portion d5 of the golf-club holder d being inserted into the bottom entry of the sliding recess a8. As the flat portion d5 slides along the sliding recess a8, the tapered structure of the sliding recess a8 secures the golf-club holder d eventually. To operate in a reverse way, the laser bracket a can be easily taken off the golf-club holder d, thereby the laser aiming device is decoupled from a golf putter 10.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A mount for attaching a laser aiming device to a golf putter, comprising:

a laser bracket for housing a laser aiming device, said laser bracket being provided with a sliding recess on a lateral side thereof, said sliding recess having an opening tapered off upwardly; and a golf-club holder having a hollow flat portion for being embedded into said sliding recess on said laser bracket and the hollow flat portion having an opening; and each of two sides of the opening having a through hole;

a hollow circular portion for holding a golf-club shaft, and the hollow flat portion being communicated to the hollow circular portion; a width of the hollow flat portion is wider than that of the hollow circular portion;

wherein an inner wall of said circular portion of said golf-club holder is provided with two non-slip rubber pads, wherein a shape of each non-slip rubber pad is matched to one inner side wall of hollow circular portion; and an outer side of said circular portion of said golf-club holder is provided with a retaining screw, the retaining screw passing through the two through holes in two sides of the opening;

wherein said rubber pad and said retaining screw enhancing said golf-club holder gripping a golf putter;

whereby said laser bracket can be fastened together with said golf-club holder as said flat portion is inserted along said sliding recess.

* * * * *